US005400937A

United States Patent [19]

Rottenberg

[11] Patent Number: 5,400,937

[45] Date of Patent: Mar. 28, 1995

[54] SKI AND SKI POLE CARRYING DEVICE

[76] Inventor: Jason L. Rottenberg, 4905 MacArthur Blvd., NW., Washington, D.C. 20007

[21] Appl. No.: 158,506

[22] Filed: Nov. 29, 1993

[51] Int. Cl.[6] ..... A45F 3/14

[52] U.S. Cl. ..... 224/258; 224/257; 224/202; 224/917

[58] Field of Search ..... 224/257, 258, 202, 150, 224/917; 280/814, 815; 294/146, 147, 149, 150, 152

[56] References Cited

U.S. PATENT DOCUMENTS

| | | | |
|---|---|---|---|
| 2,118,875 | 5/1938 | Windheim | 294/147 X |
| 2,530,695 | 11/1950 | Helmert | 224/917 X |
| 3,960,302 | 6/1976 | Mazzoni | 224/257 X |
| 4,456,284 | 6/1984 | Saka | 224/917 X |
| 4,463,885 | 8/1984 | Ball et al. | 224/917 X |
| 4,658,999 | 4/1987 | Hilty | 224/917 X |
| 4,729,591 | 3/1988 | Scalise | 224/917 X |
| 4,792,073 | 12/1988 | Jacober | 224/917 X |
| 4,903,875 | 2/1990 | Smart et al. | 224/917 X |
| 5,104,017 | 4/1992 | Vandagriff | 224/917 X |
| 5,139,187 | 8/1992 | Fowler | 224/917 x |

FOREIGN PATENT DOCUMENTS

| | | | |
|---|---|---|---|
| 300971 | 1/1989 | European Pat. Off. | 224/917 |
| 2571625 | 4/1986 | France | 224/917 |
| 9007960 | 7/1990 | WIPO | 224/917 |

*Primary Examiner*—Henry J. Recla

*Assistant Examiner*—David J. Walczak

*Attorney, Agent, or Firm*—Hugh E. Smith

[57] ABSTRACT

A device for the hands-free carrying of skis and ski poles. The device comprises a carrying strap having a first and second end, and a length adapted to fit around a person. The carrying strap has securement means at the ends adapted to receive and hold the carrying strap in a closed loop configuration around the person. A pouch has an open end and a closed end. The pouch couples the carrying strap with the open end facing upwards. The pouch is adapted to hold the ends of skis and ends of ski poles. A plurality of ski straps have first and second ends and an intermediate portion therebetween with a length adapted to fit around a plurality of skis. The intermediate portion of each ski strap is coupled to the carrying strap. Each ski strap further has a securement member at the first and second ends adapted to receive and hold the ski straps in a closed loop configuration around skis that are inserted into the open end of the pouch. Also provided are a plurality of pole straps having first and second ends and an intermediate portion therebetween with a length adapted to fit around a plurality of ski poles. The intermediate portion of each pole strap couples to the carrying strap. Each pole strap further has a securement component at the first and second ends. The securement component is adapted to receive and hold the pole strap in a closed loop configuration around ski poles that are inserted into the open end of the pouch.

4 Claims, 3 Drawing Sheets

FIG 1
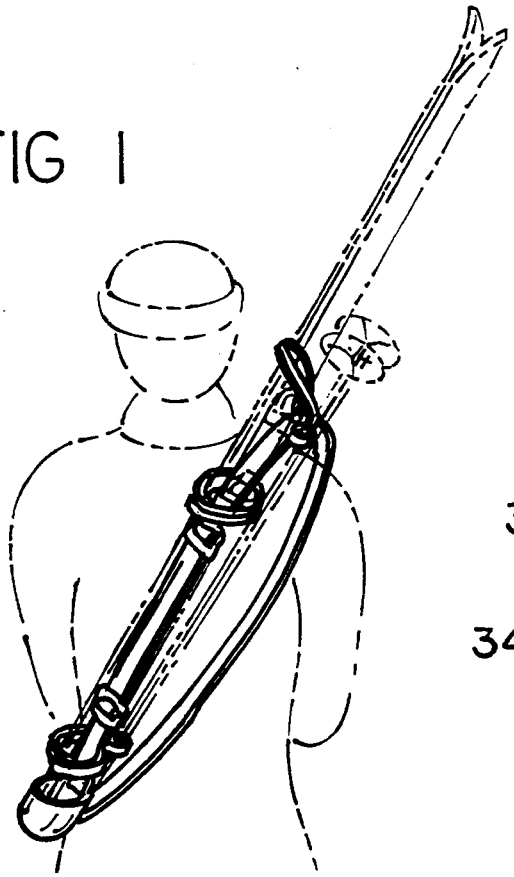
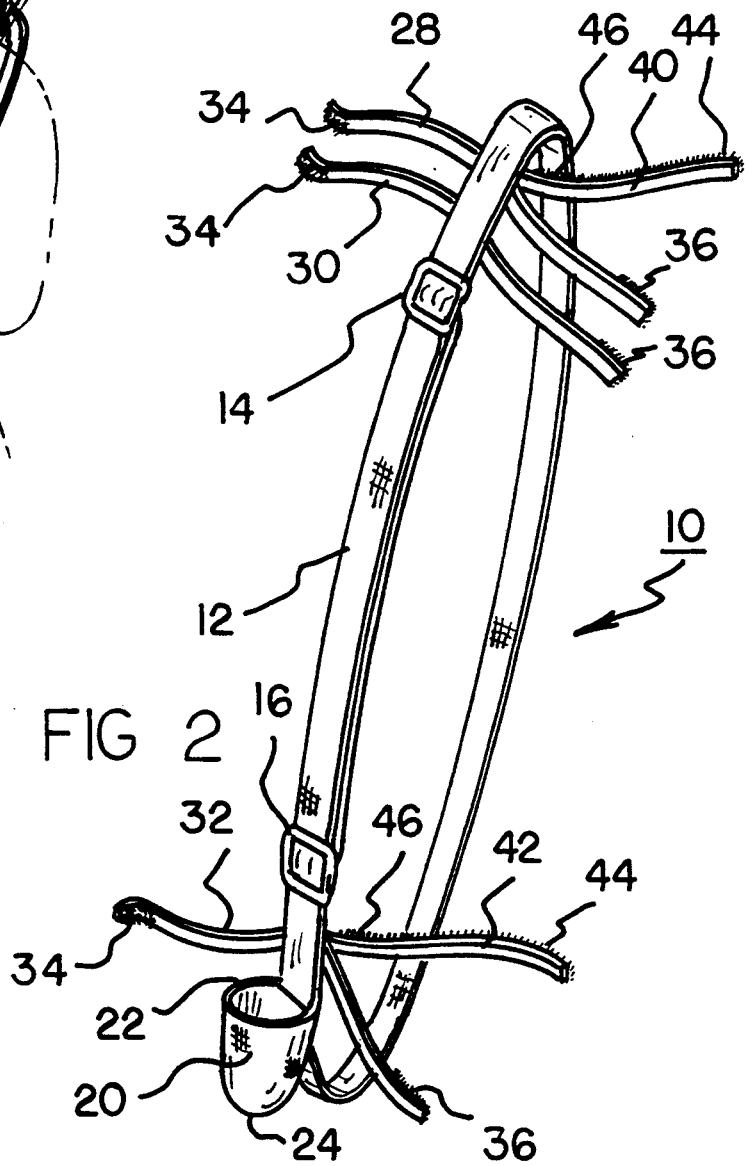
FIG 2

SKI AND SKI POLE CARRYING DEVICE

BACKGROUND OF THE INVENTION

1. Field of the Invention

The present invention relates to ski and ski pole carrying devices and more particularly pertains to a device which is used to manually carry skis and, ski poles from a shoulder.

2. Description of the Prior Art

The use of various carrying devices is known in the prior art. More specifically, devices heretofore devised and utilized for the purpose of carrying various articles are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 4,308,982 to Hall;, and 4,463,885 to Ball;, 4,792,073 to Jacober;, 4,903,875 to Smart;, and 4,658,999 to Hilty, all depict devices used to hold and carry skis and ski poles. Another patent of interest is U.S. Pat. No. 3,685,667, which depicts a holder apparatus for skis alone.

While these devices fulfill their respective, particular objective and requirements, the aforementioned patents do not describe a lightweight device that is used by a skier to carry both skis and ski poles over the shoulder while simultaneously freeing the hands from this carrying process. These features are especially important to cross country skiers, who usually have to hike a long distance over rough terrain in order to access ski trails. Furthermore, the device allows the skier to quickly access the equipment for use.

In this respect, the ski and ski pole carrying device according to the present invention substantially departs from the conventional concepts and designs of the prior art, and in doing so provides an apparatus primarily developed for the purpose of manually carrying skis and ski poles from a shoulder.

Therefore, it can be appreciated that there exists a continuing need for an improved device which can be used to carry skis and ski poles. In this regard, the present invention substantially fulfills this need.

SUMMARY OF THE INVENTION

In the view of the foregoing disadvantages inherent in the known types of devices used for carrying skis and ski poles now present in the prior art, the present invention provides and improved device for carrying skis and ski poles. As such, the general purpose of the present invention, which will be described subsequently in greater detail, is to provide a new and improved device for carrying skis and ski poles which has all the advantages of the prior art and none of the disadvantages.

To attain this, the present invention essentially is in a ski and ski pole carrying device comprising, in combination improved device for the convenient, hands-free carrying of skis and ski poles comprising, in combination. A flexible carrying strap having a length adapted to fit around a skier from the shoulder, across the back, and to the hip opposite the shoulder. An upper and a lower buckle coupled to the carrying strap to define a closed loop configuration with the carrying strap, with the buckles being adjustable along the carrying strap to enlarge or reduce the circumference of the loop. A pouch having an open upper end and a closed lower end, the pouch coupled to the carrying strap below the lower buckle with the open end facing upwards and having an axis essentially aligned with the carrying strap, the pouch adapted to hold the rear ends of skis and the handles of ski poles. A first ski strap, a second ski strap, and a third ski strap, each ski strap having a first end, a second end, and an intermediate portion therebetween, each first end further having a strip of a pile type fastener attached thereto, each second end further having a complementary strip of a pile type fastener attached thereto, the intermediate portion of the first ski strap attached to the carrying strap above the upper buckle, the intermediate portion of the second ski strap attached to the carrying strap above the upper buckle at a position offset below the first ski strap, and the intermediate portion of the third ski strap attached to the carrying strap between the lower buckle and the pouch, each ski strap adapted to be coupled with the pile type fastener around skis whose ends are inserted into the open end of the pouch such that the skis are essentially aligned with and secured to the carrying strap, with the first and second strap further adapted to be coupled around the skis above and below the skis' upper bindings. Also a first pole strap and a second pole strap, each pole strap having a first end and a second end, each first end further having a strip of a pile type fastener attached thereto, each second end having a complementary strip of a pile type fastener attached thereto, the second end of the first pole strap attached to the carrying strap adjacent to the first ski strap, the second end of the second pole strap attached to the carrying strap adjacent to the third ski strap, each pole strap adapted to be coupled with the pile type fastener around poles whose handles that are inserted into the open end of the pouch such that the poles are essentially aligned with and secured to the carrying strap.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The specification is neither intended to define the invention of the application, which is measured by the claims, nor is it intended to be limiting as to the scope of the invention in any way.

It is therefore an object of the present invention to provide a new and improved device for carrying skis and ski poles which has all the advantages of the prior art and none of the disadvantages.

It is another object of the present invention to provide a new and improved device for carrying skis and ski poles which may be easily and efficiently manufactured and marketed.

It is a further object of the present invention to provide a new and improved device for carrying skis and ski poles which is of durable and reliable construction.

An even further object of the present invention is to provide a new and improved device for carrying skis and ski poles which is susceptible of a low cost of manufacture with regard to both materials and labor, and which accordingly is then susceptible of low prices of sale to the consuming public, thereby making such a device for carrying skis and ski poles economically available to the buying public.

Still another object of the present invention is to provide a new and improved device for carrying skis and ski poles which provides in the apparatuses and methods of the prior art some of the advantages thereof, while simultaneously overcoming some of the disadvantages normally associated therewith.

Still another object of the present invention to provide a new and improved device for carrying skis and ski poles which is of lightweight construction.

Yet another object of the present invention is to free the hands of a skier from the process of carrying skis and ski poles.

Yet another object of the present invention is to allows a skier to have quick and easy access to skis and ski poles being carried.

Lastly, it is an object of the present invention to provide a device for the hands-free carrying of skis and ski poles comprising of a carrying strap having a first and second end, and a length adapted to fit around a person, the carrying strap having securement means at the ends adapted to receive and hold the carrying strap in a closed loop configuration around the person. A pouch having an open end and a closed end, the pouch coupled to the carrying strap with the open end facing upwards, the pouch adapted to hold the ends of skis and ends of ski poles. A plurality of ski straps having a first and second ends, and an intermediate portion therebetween, with a length adapted to fit around a plurality of skis, the intermediate portion of each ski strap coupled to the carrying strap, each ski strap further having securement means at the first and second ends, the securement means adapted to receive and hold the ski straps in a closed loop configuration around skis that are inserted into the open end of the pouch, and a plurality of pole straps, each strap having a first and second ends, and an intermediate portion therebetween, with a length adapted to fit around a plurality of ski poles, the intermediate portion of each pole strap coupled to the carrying strap, each pole strap further having a securement means at the first and second ends, the securement means adapted to receive and hold the pole strap in a closed loop configuration around ski poles that are inserted into the open end of the pouch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the device for carrying skis and ski poles constructed in accordance with the principles of the present invention in operation;

FIG. 2 is a perspective view of the device while not in operation;

DESCRIPTION OF THE PREFERRED EMBODIMENT

Figure 3:
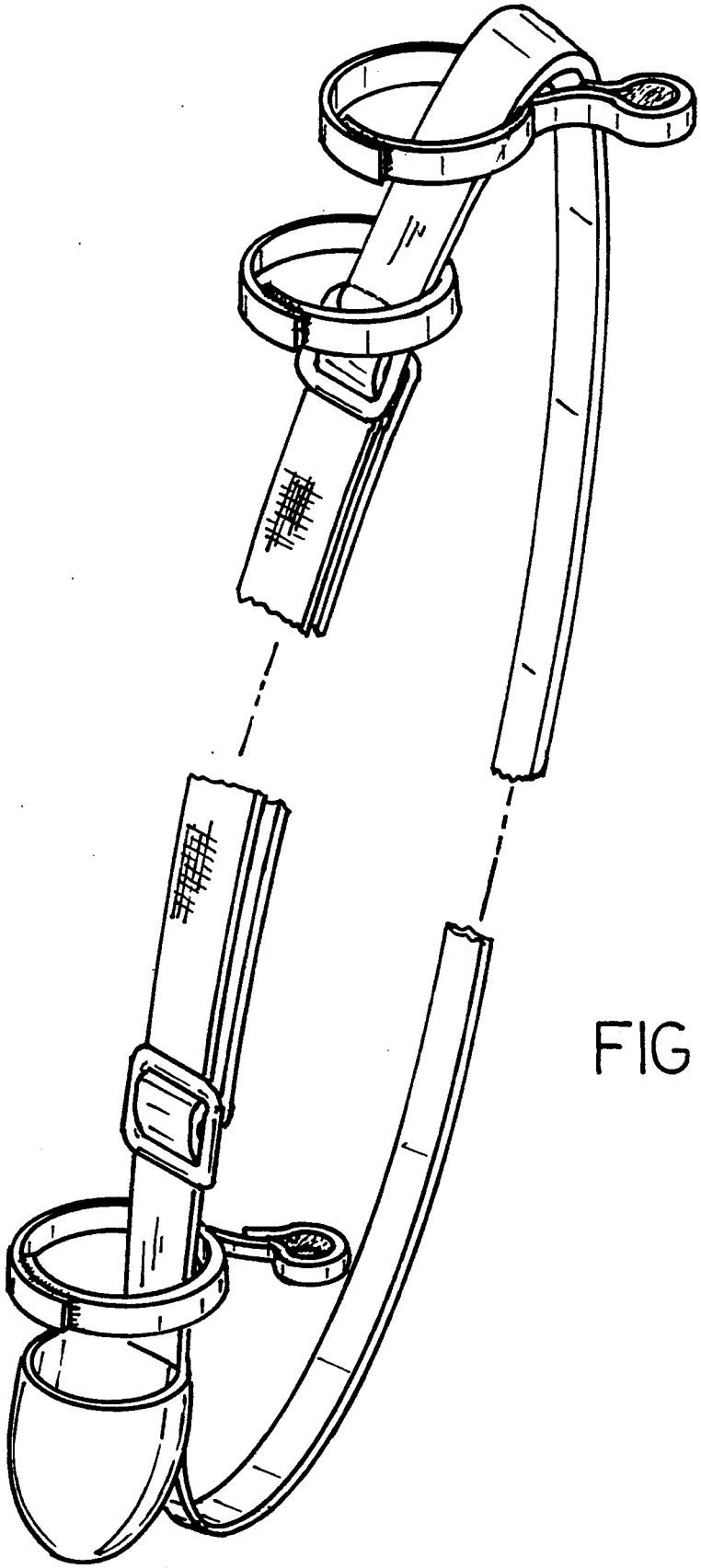
FIG. 3 is an enlarged perspective view of the device with ski and ski poles straps depicted in the closed position.

With reference now to the drawings, and in particular, to FIG. 1 through 5 thereof, a new and improved device for carrying skis and ski poles embodying the principles and concepts of the present invention and generally designated by the reference number 10 will be described.

The ski and ski pole carrying device 10 comprises a flexible carrying strap 12 having a length adapted to fit around a skier from the shoulder, across the back, and to the hip opposite the shoulder. An upper and a lower buckle 14 and 16 coupled to the carrying strap to define a closed loop configuration with the carrying strap. The buckles are adjustable along the carrying strap to enlarge or reduce the circumference of the loop.

A pouch 20 having an open end 22 and a closed end 24 is coupled to the carrying strap below the lower buckle. The open end faces upwards and has an axis which is essentially aligned with the carrying strap. The pouch is adapted to hold the ends of skis and the handles of ski poles. Note FIG. 1.

The device includes a first ski strap 28, a second ski strap 30, and a third ski strap 32. Each ski strap has a first end, a second end, and an intermediate portion therebetween. Each first end includes a strip of a pile type fastener 34 attached thereto. Each second end further includes a complementary strip of a pile type fastener 36 attached thereto.

The intermediate portion of the first ski strap 28 is attached to the carrying strap above the upper buckle 14. The intermediate portion of the second ski strap is attached to the carrying strap above the upper buckle at a position below the first ski strap.

The intermediate portion of the third ski strap is attached to the carrying strap between the lower buckle 32 and above the pouch 20. Each ski strap is adapted to be coupled with the pile type fasteners 34 and 36 around skis whose ends are inserted into the open end of the pouch 24. In this manner the skis are essentially aligned with and secured to the carrying strap. The first and second strap are further adapted to be coupled around the skis above and below the upper bindings of the skis.

The device 10 further includes a first pole strap 40 and a second pole strap 42. Each pole strap has a first end and a second end. Each first end further includes a strip of a pile type fastener 44 attached thereto, and each second end further includes a complementary strip of a pile type fastener 46 attached thereto which, in the preferred. embodiment, is simply an extension of the first. The second end of the first pole strap is attached to the carrying strap adjacent to the first ski strap. The second end of the second pole strap is attached to the carrying strap adjacent to the third ski strap. Each pole strap is adapted to be coupled with the pile type fastener around poles whose handles that are inserted into the open end of the pouch. In this manner the poles are essentially aligned with and secured to the carrying strap.

A second embodiment of the present invention includes an auxiliary pouch 50 that is coupled to the carrying strap 12. Coupling is effected by passing the strap 12 through a channel in a rearward pouch extension 52. The pouch is used for holding ski wax, lotion, sunglasses, and similar items used when skiing. Note FIG. 4.

Figure 4:
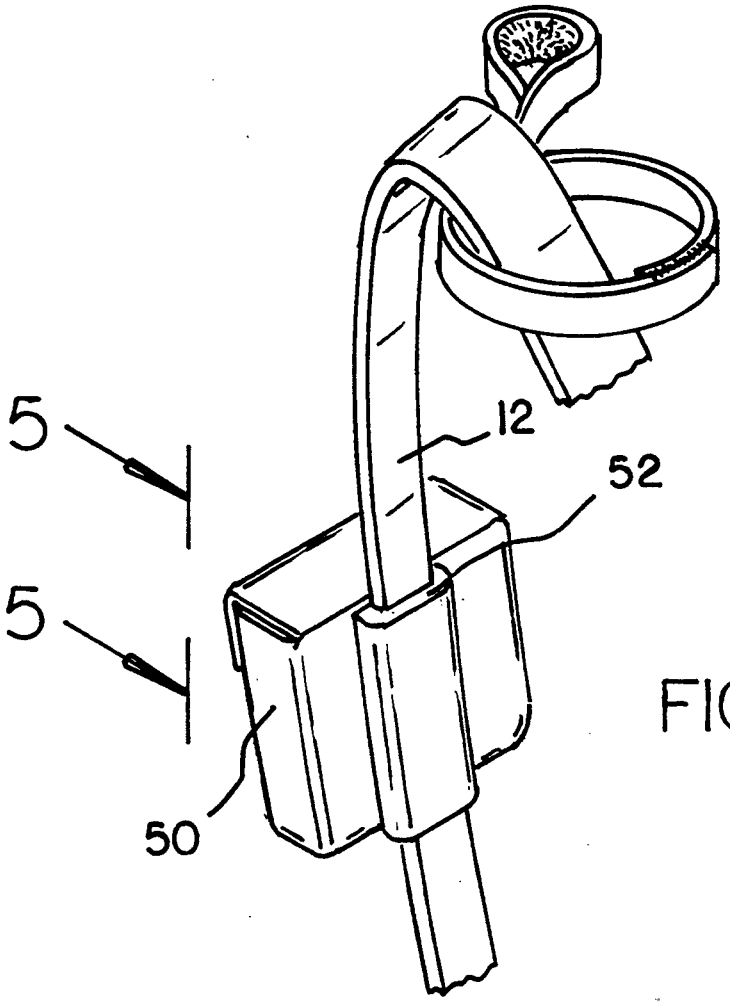
FIG. 4 is a view of the auxiliary pouch constructed in accordance with an alternate embodiment of the invention; and, FIG. 5 is a view of the buttons on the auxiliary pouch taken along the line 5—5 of FIG. 4.
Figure 5:
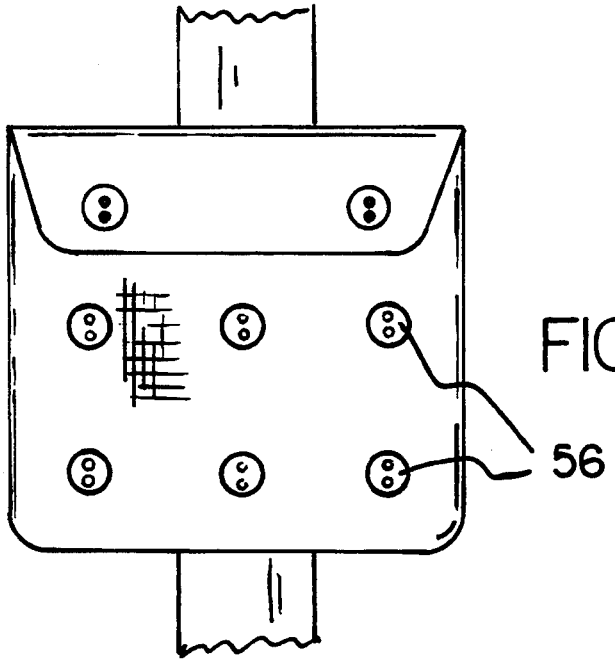

A third embodiment of the present invention is shown in FIG. 5 and includes an auxiliary pouch as shown in FIG. 4. The pouch is provided with a plurality of buttons 56 attached thereon. Ski lift tickets are attached to the pouch using these buttons.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An improved device for the convenient, hands-free carrying of skis with front ends and rear ends and upper bindings and also ski poles with handles comprising, in combination:

a flexible carrying strap having a length adapted to fit around a skier from the shoulder, across the back, and to the hip opposite the shoulder;

an upper and a lower buckle coupled to the carrying strap to define a closed loop configuration having a circumference and with the carrying strap, with the buckles being adjustable along the carrying strap to enlarge or reduce the circumference of the loop;

a pouch having an open upper end and a closed lower end, the pouch coupled to the carrying strap below the lower buckle with the open end facing upwards and having an axis essentially aligned with the carrying strap, the pouch adapted to hold the rear ends of skis and the handles of ski poles;

a first ski strap, a second ski strap, and a third ski strap, each ski strap having a first end, a second end, and an intermediate portion therebetween, each first end further having a strip of a pile type fastener attached thereto, each second end further having a complementary strip of a pile type fastener attached thereto, the intermediate portion of the first ski strap attached to the carrying strap above the upper buckle, the intermediate portion of the second ski strap attached to the carrying strap above the upper buckle at a position offset below the first ski strap, and the intermediate portion of the third ski strap attached to the carrying strap between the lower buckle and the pouch, each ski strap adapted to be coupled with the pile type fastener around skis whose ends are inserted into the open end of the pouch such that the skis are essentially aligned with and secured to the carrying strap, with the first and second strap further adapted to be coupled around the skis above and below the skis' upper bindings; and a first pole strap and a second pole strap, each pole strap having a first end and a second end, each first end further having a strip of a pile type fastener attached thereto, each second end having a complementary strip of a pile type fastener attached thereto, the second end of the first pole strap attached to the carrying strap adjacent to the first ski strap, the second end of the second pole strap attached to the carrying strap adjacent to the third ski strap, each pole strap adapted to be coupled with the pile type fastener around poles whose handles that are inserted into the open end of the pouch such that the poles are essentially aligned with and secured to the carrying straps.

2. A device for the hands-free carrying of skis with ends and ski poles with ends comprising:

a carrying strap having a first and second end, and a length adapted to fit around a person, the carrying strap having securement means at the ends adapted to receive and hold the carrying strap in a closed loop configuration around the person;

a pouch having an open end and a closed end, the pouch coupled to the carrying strap with the open end facing upwards, the pouch adapted to hold the ends of skis and ends of ski poles;

a plurality of ski straps having a first and second ends, and an intermediate portion therebetween, with a length adapted to fit around a plurality of skis, the intermediate portion of each ski strap coupled to the carrying strap, each ski strap further having securement means adapted to receive and hold the ski straps in a closed loop configuration around skis that are inserted into the open end of the pouch; and a plurality of pole straps, each pole strap having a first and second ends, and an intermediate portion therebetween, with a length adapted to fit around a plurality of ski poles, one end portion of each pole strap coupled to the carrying strap, each pole strap further having a securement means at the first and second ends, the securement means adapted to receive and hold the pole strap in a closed loop configuration around ski poles that are inserted into the open end of the pouch.

3. The device as set forth in claim 2 further including an auxiliary pouch coupled to the carrying strap for holding ski wax, lotion, and sunglasses used when skiing.

4. The device as set forth in claim 3 wherein the auxiliary pouch includes a plurality of buttons attached thereon for attaching ski lift tickets.

* * * * *